US010036179B1

(12) United States Patent
Bertuch

(10) Patent No.: US 10,036,179 B1
(45) Date of Patent: Jul. 31, 2018

(54) MADE IN THE SHADE

(71) Applicant: Jeffrey David Bertuch, Smyrna, TN (US)

(72) Inventor: Jeffrey David Bertuch, Smyrna, TN (US)

( * ) Notice: Subject to any disclaimer, the term of this patent is extended or adjusted under 35 U.S.C. 154(b) by 0 days.

(21) Appl. No.: 15/582,506

(22) Filed: Apr. 28, 2017

(51) Int. Cl.
*E04H 15/58* (2006.01)
*E04H 15/02* (2006.01)
*E04H 15/46* (2006.01)

(52) U.S. Cl.
CPC ..... *E04H 15/58* (2013.01); *E04H 15/02* (2013.01); *E04H 15/46* (2013.01)

(58) Field of Classification Search
CPC ..... E04H 15/005; E04H 15/02; E04H 15/58
See application file for complete search history.

(56) References Cited

U.S. PATENT DOCUMENTS 4,506,688 A * 3/1985 Bethoon ..... E04H 15/58 135/117
4,805,654 A * 2/1989 Wang ..... B60J 11/00 135/139
5,088,514 A * 2/1992 House ..... E04H 15/003 135/139
5,385,161 A * 1/1995 Loker ..... A45B 11/00 135/15.1
5,437,298 A * 8/1995 Lin ..... E04H 15/58 108/129
5,595,204 A * 1/1997 Hwang ..... E04H 15/48 135/142
5,700,048 A * 12/1997 Wade ..... B60P 3/343 135/88.05
5,921,259 A * 7/1999 Ehler ..... A45B 11/00 135/119
7,240,684 B2 * 7/2007 Yang ..... B60J 7/11 135/88.07
7,789,097 B1 * 9/2010 Sotirkys ..... E04H 15/06 135/88.01
8,567,423 B1 * 10/2013 Combs, Jr. ..... E04H 15/32 135/120.3
8,714,511 B2 * 5/2014 Zoeteman ..... A45B 23/00 135/16
9,051,756 B1 * 6/2015 Jenkins ..... E04H 15/58
9,194,154 B2 * 11/2015 Martin ..... E04H 15/48
2002/0139403 A1 * 10/2002 Shi ..... A45B 11/00 135/16
2008/0230104 A1 * 9/2008 Potter ..... E04H 15/06 135/88.14

* cited by examiner

*Primary Examiner* — David R Dunn
*Assistant Examiner* — Danielle Jackson
(74) *Attorney, Agent, or Firm* — Michael S. Fuller

(57) ABSTRACT

An apparatus for providing shade or protection from the elements to an audio console includes frame, a panel, a couple of clips, a telescopic leg assembly, and a couple of magnetic leveling pads. The frame upholds the panel which prevents light and precipitation from passing through and coming into contact with the area beneath the panel. The couple of clips mount the apparatus onto the displays of the audio console. The telescopic leg assembly adjusts the angle of the panel in respect to the keyboard of the audio console. The couple of magnetic leveling pads fastens the telescopic leg assembly to a neighboring surface and fixes the angle of the telescopic leg assembly.

1 Claim, 10 Drawing Sheets

MADE IN THE SHADE

FIELD OF THE INVENTION

The present invention relates to an audio console accessory. More specifically, the present invention relates to an audio console shade.

BACKGROUND OF THE INVENTION

Audio consoles are a necessity at many social events such as concerts and parties. If the event is outside, it may be difficult for the user of the audio console user to maneuver console with the sun shining in his or her eyes, with the sun shining on the console, or glare from decorative lights. The blinding sunlight is not the only possible difficulty of maneuvering an audio console. The event may be held on a rainy day and the precipitation may damage the audio console. If the event is inside, the audio console user may also be blinded by decorative lights or may not be able to view the displays of the audio console due to a glare. Though there many ways to create a shaded area, there is none that is universal, adjustable, and separable.

The present invention provides direct shade to an engaged audio console. The present invention comprises separable members that allow the apparatus to be easily stored and transported. The shade of the present invention may be customizable depending on the light of the surrounding environment. The present invention comprises a frame, a panel, a couple of clips, a telescopic leg assembly, and a couple of magnetic leveling pads. The frame upholds the panel which prevents light and precipitation from passing through and coming into contact with the area beneath the panel. The couple of clips mount the apparatus onto the displays of the audio console. The telescopic leg assembly adjusts the angle of the panel in respect to the keyboard of the audio console. The couple of magnetic leveling pads fastens the telescopic leg assembly to a neighboring surface and fixes the angle of the telescopic leg assembly.

SUMMARY OF THE INVENTION

The present invention comprises a frame, a panel, a couple of clips, a telescopic leg assembly, and a couple of magnetic leveling pads. The frame upholds the panel. The frame comprises a couple of connecting posts, a couple of anchoring posts, and a plurality of end caps. The panel provides shade to the area directly beneath it, more specifically, the panel provides shade for an engaged audio console. The couple of clips attaches the frame of the apparatus to the uppermost edge of the display of an audio console. Each of the couple of clips comprise a hook and a slot. The couple of telescopic legs are opposite the couple of clips along the frame. Each of the telescopic legs comprise an outer rod, an inner rod, and a fastener. The couple of telescopic legs define the angle of the panel in respect to the keyboard of an engaged audio console. Each of the couple of magnetic leveling pads are fixed to corresponding telescopic legs, opposite the frame. Each of the magnetic leveling pads comprise a ball and socket joint and a magnetic base. The present invention may be anchored to the display of a variety of audio consoles. The present invention may provide shade along any desired area of an audio console as the angle of the panel is adjustable via the couple of telescopic legs.

DETAIL DESCRIPTIONS OF THE INVENTION

All illustrations are for the purpose of describing selected versions of the present invention and are not intended to limit the scope of the present invention.

Figure 4:
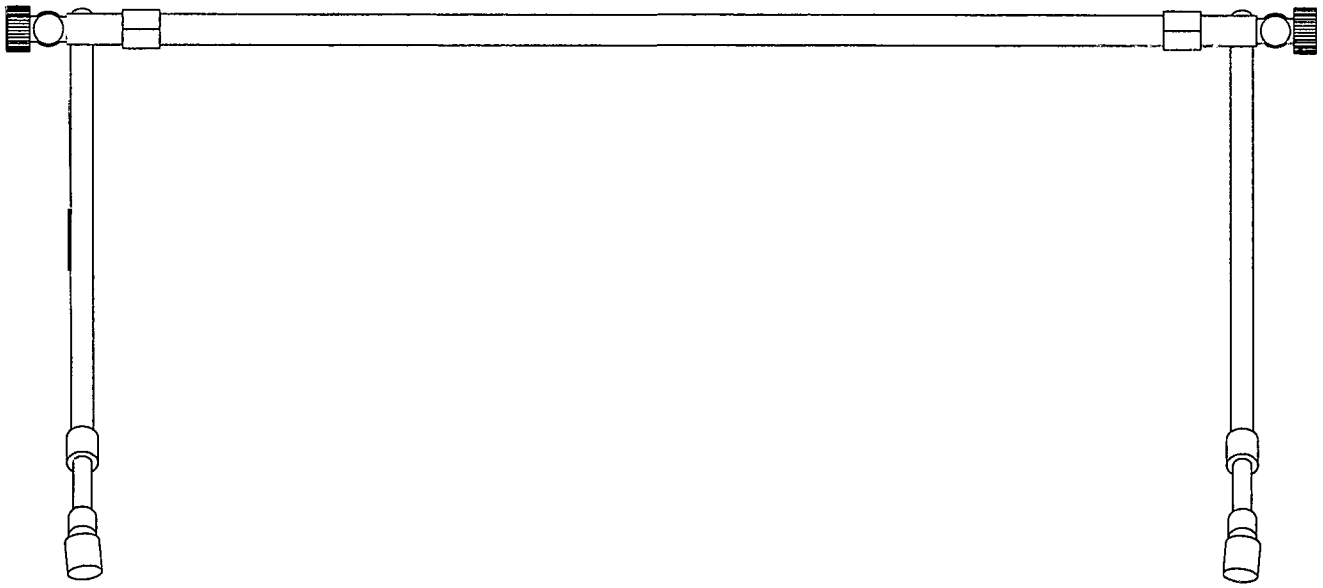
FIG. 4 is a front side view of the present invention.

The present invention comprises a frame, a panel, a couple of clips, a telescopic leg assembly, and a couple of magnetic leveling pads. The frame upholds the panel. The frame comprises a couple of connecting posts, a couple of anchoring posts, and a plurality of end caps. The couple of connecting posts connects the couple of anchoring posts to one another. The preferred embodiment of the couple of connecting posts are parallel to one another and are orthogonal to the couple of anchoring posts. Each of the couple of connecting posts comprise a couple of slots. Each of the couple of slots laterally extrude through the corresponding distal ends of the connecting post. Each of the couple of anchoring posts laterally traverse the corresponding edges of the panel. the couple of slots of a connecting post houses the couple of anchoring posts. The couple of anchoring posts comprises a primary anchoring post and a secondary anchoring post. The primary anchoring post is engaged with the couple of clips, as illustrated in the front view of FIG. 4, and is adjacent to the uppermost edge of the display of an audio console. The secondary anchoring post is engaged with the telescopic leg assembly and pivots about the primary anchoring post as defined by the length of the couple of telescopic legs. The distance between the couple of connecting posts and the distance between couple of anchoring posts is defined by the panel.

The engagement between a connecting post and an anchoring post is secured by an end cap. Each of the plurality of end caps fastens onto the distal surface of an anchoring post such that a corresponding connecting post is between the end cap and the panel. The preferred embodiment of the frame comprises a couple of anchoring posts and a plurality of end caps with threaded members that fasten together. Alternate embodiments of the frame may comprise a variety of locking means between the anchoring posts and the plurality of end caps.

Figure 1:
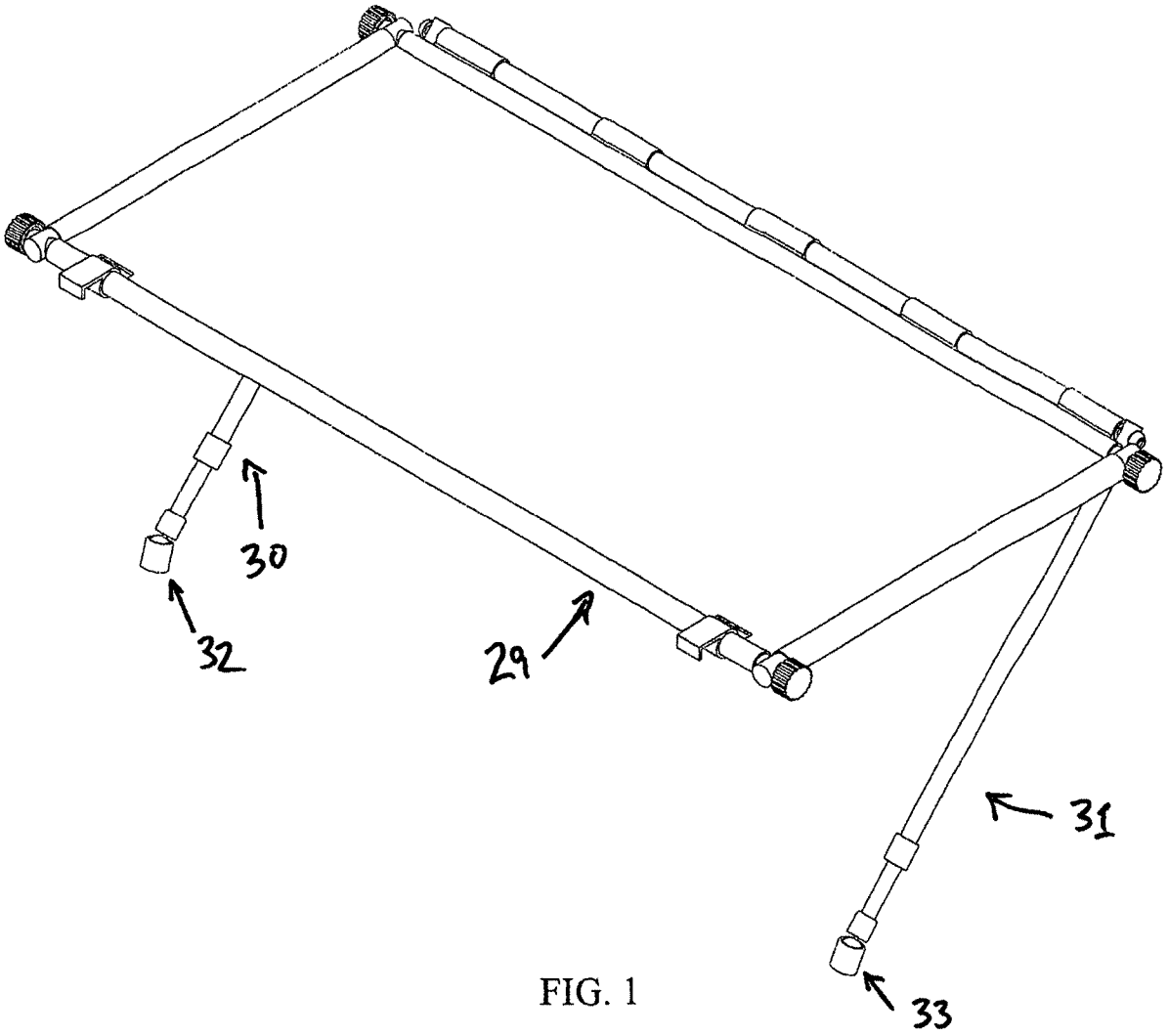
FIG. 1 is a top perspective view of the present invention with the couple of telescopic legs and couple of magnetic leveling pads angled towards the panel.

The panel is cover that prevents light and liquid from passing through the perimeter defined by the frame. The panel comprises a body, a plurality of frame sleeves, and a leg sleeve. The body is flexible sheet that encompasses the area within the frame as defined by the frame. The body of the preferred embodiment comprises a rectangular cross-sectional shape. The body comprises a couple of slots that vertically extrude near the distal ends of the edge adjacent to the primary anchoring post. Each of the couple of slots accommodates the corresponding couple of clips, as shown in the perspective view of FIG. 1. The panel preferably comprises waterproof and opaque flexible materials to provide shade to an engaged audio console regardless of the type of weather.

Figure 10:
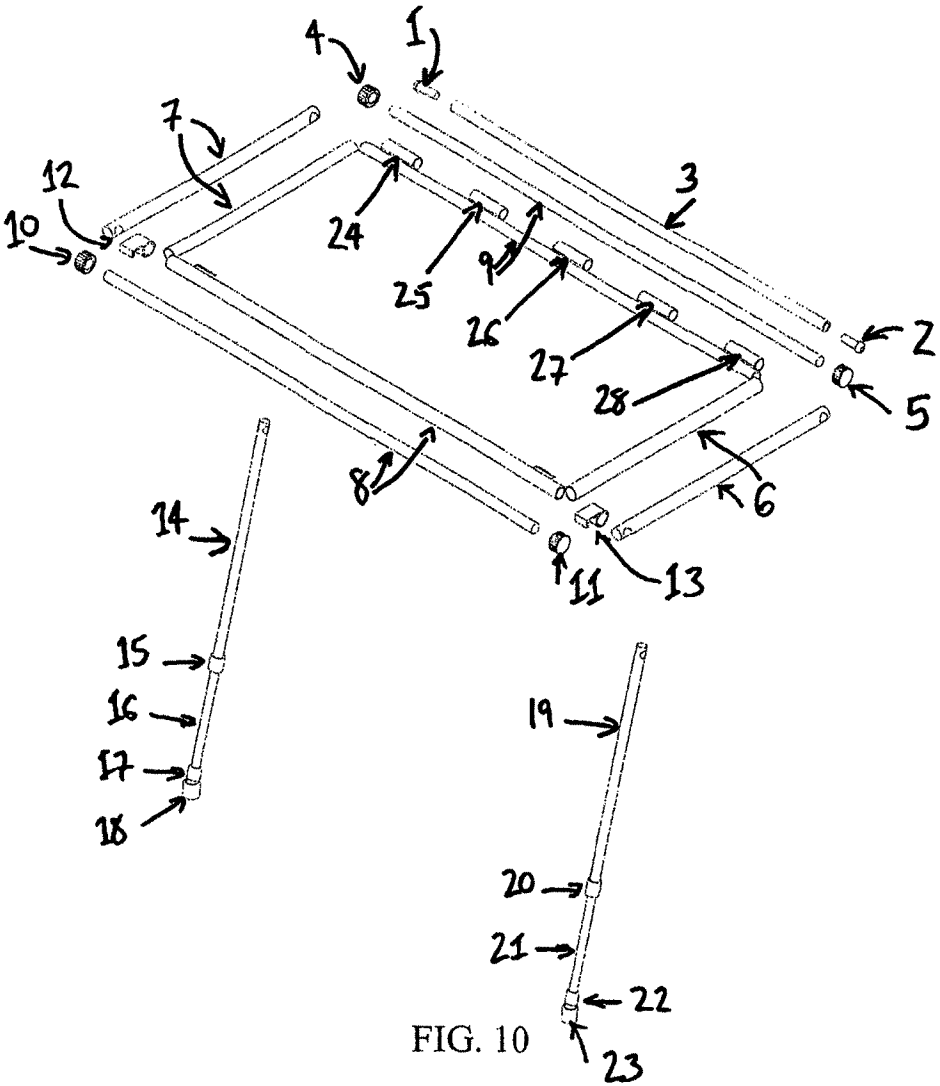
FIG. 10 is an exploded view of the present invention.

The plurality of frames sleeves traverses the edges of the body. The plurality of frame sleeves each comprise a channel that is parallel to the corresponding edge of the body. Each of the plurality of frame sleeves house a connecting post or an anchoring post. The frame sleeve that houses the secondary anchoring post is adjacent to the leg sleeve. The leg sleeve is parallel to the frame sleeve that houses the secondary post and is opposite the body of the panel, as shown in the exploded view of FIG. 10. The openings of the frame sleeve are parallel to the openings of the leg sleeve. The leg sleeve retains the telescopic leg assembly.

Figure 2:
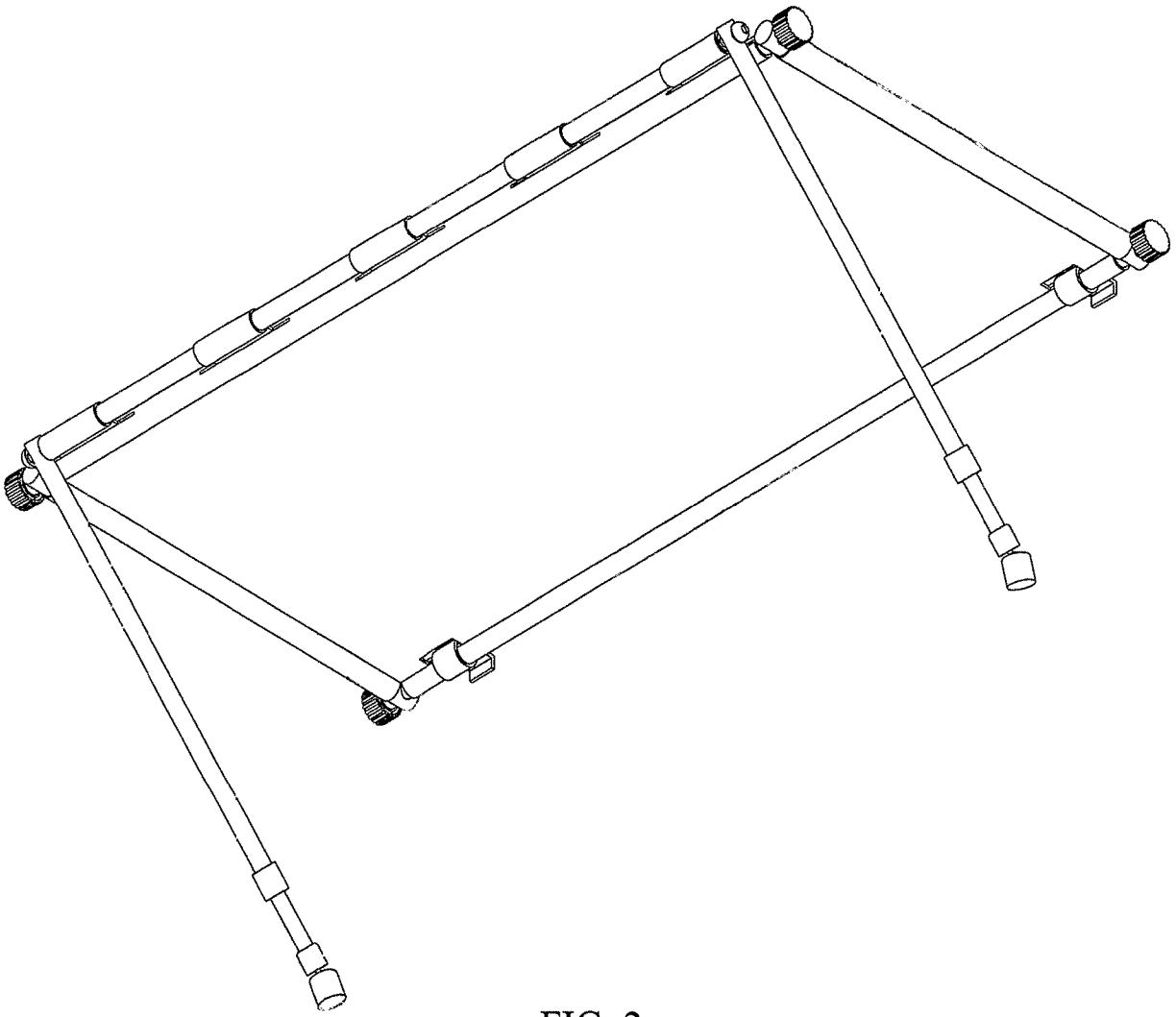
FIG. 2 is a bottom perspective view of the present invention.

The couple of clips comprise a hook and a channel. The opening of the hook is perpendicular to the channel, as seen in the perspective view of FIG. 2. The preferred embodiment of the hook comprises an L-shaped cross-sectional shape. However, alternate embodiments of the hook may comprise varying cross-sectional shapes that mount onto the display of an audio console. The channel surrounds the primary connecting post and is contained within a corresponding slot. The clip fixes the position of the primary anchoring post so that the secondary anchoring post may pivot about the primary anchoring post.

Figure 5:
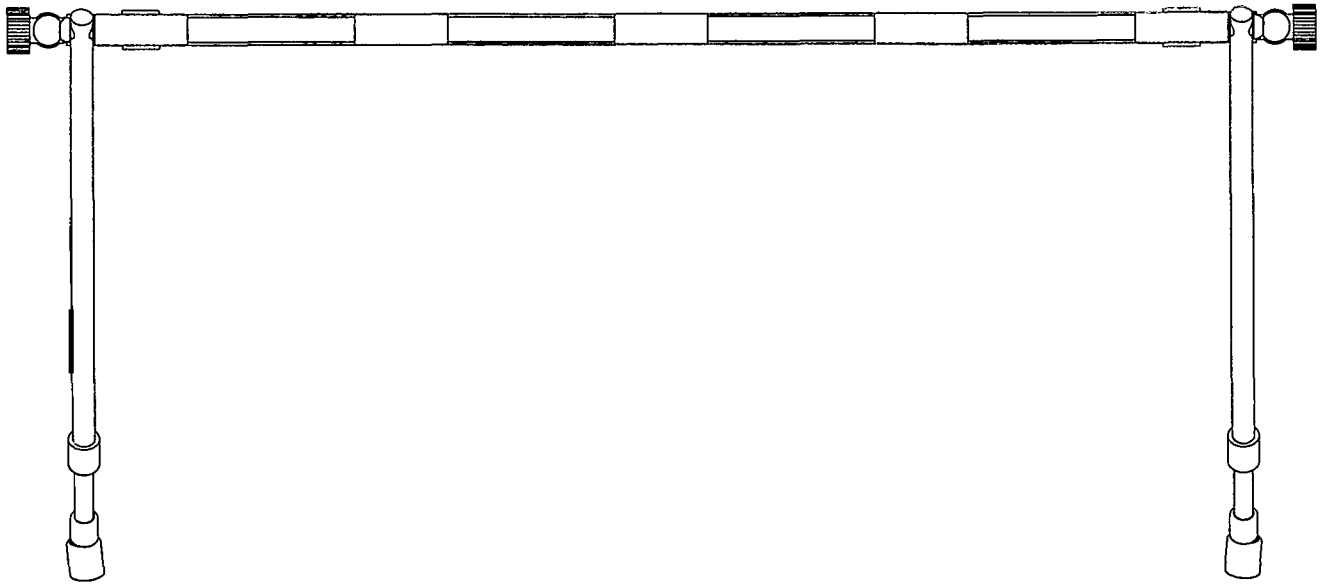
FIG. 5 is a back side view of the present invention.
Figure 6:
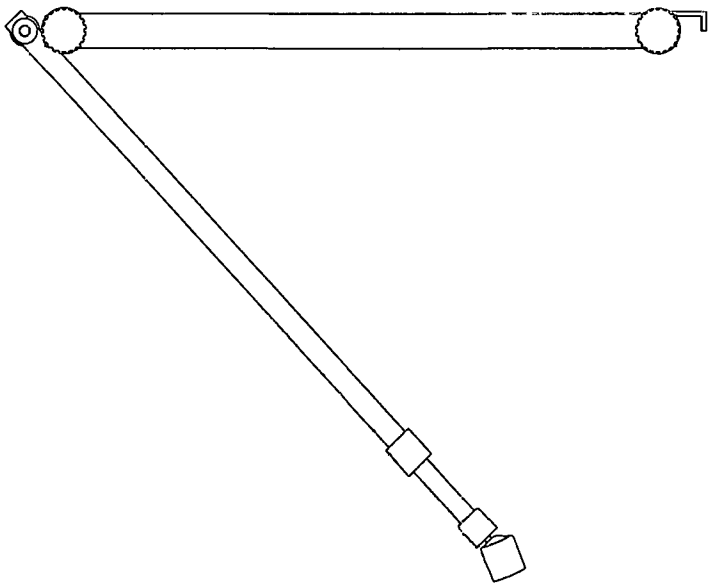
FIG. 6 is a left side view of the present invention.
Figure 7:
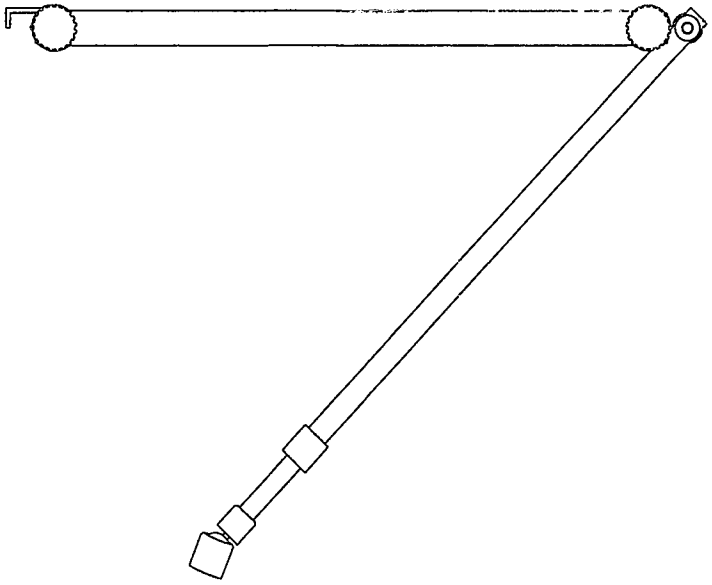
FIG. 7 is a right side view of the present invention.
Figure 8:
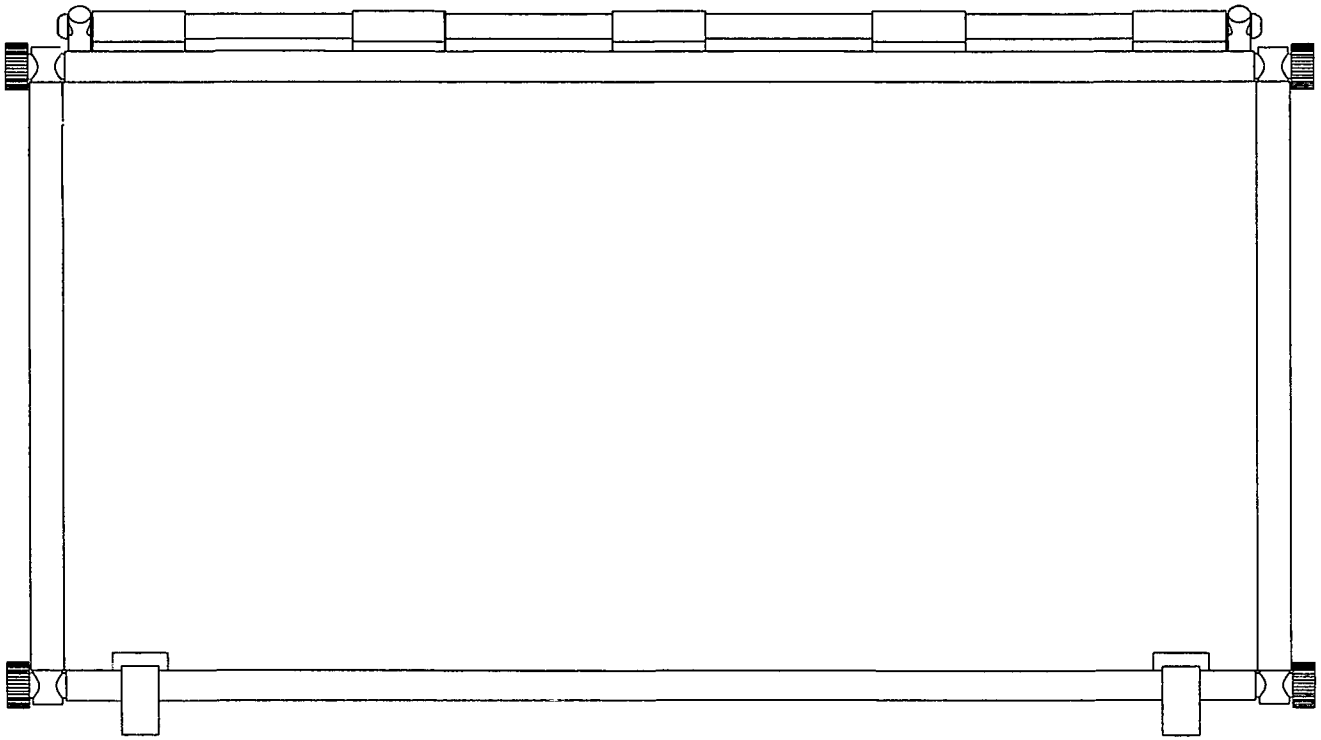
FIG. 8 is a top side view of the present invention.
Figure 9:
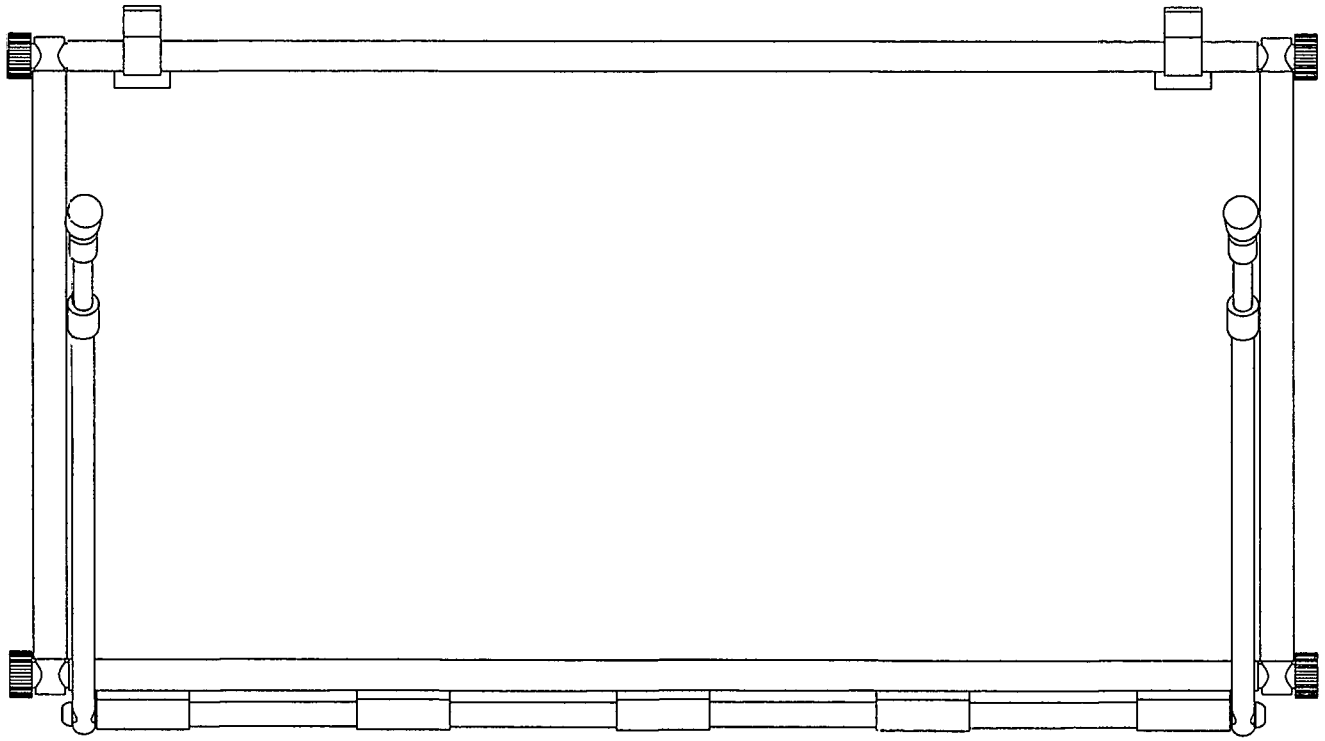
FIG. 9 is a bottom side view of the present invention.

The telescopic leg assembly determines the angle between the panel and the keyboard of an engaged audio console. The telescopic leg assembly comprises a couple of telescopic legs, a connecting leg, and a couple of fasteners. The couple of telescopic legs are pivotally secured to corresponding distal ends of the connecting leg via the couple of fasteners. The preferred embodiment of the couple of fasteners are bolts. The couple of fasteners are concentric with the connecting leg as shown in the top view of FIG. 8. The couple of telescopic legs are orthogonal to the connecting leg, as shown in the back view of FIG. 5. The connecting leg is housed within the leg sleeve of the panel. The couple of telescopic legs uphold the secondary anchoring post of the frame. The couple of telescopic rods each comprise an outer rod, an inner rod, and a lock. The outer rod surrounds the inner rod and the inner rod is slidably engaged within outer rod. The outer rod of each of the couple of telescopic rod is adjacent to the connecting leg. The inner rod of each of the couple of telescopic rods extends from the distal end of the corresponding outer rod opposite the connecting leg. The outer rod The outer rod comprises a slot. The slot is a later extrusion that houses the fastener. The lock surrounds the intersection of the outer rod and inner rod and prevents the unwanted movement of the inner rod within the outer rod.

The couple of magnetic leveling pads are each fixed to the inner rod of each of the couple of telescopic legs. The couple of magnetic leveling pads secures the couple of telescopic legs to any neighboring surface near an engaged audio console. Each of the couple of magnetic leveling pads comprise a ball and socket joint and a magnetic base. The ball and socket joint is fixed to the distal end of the corresponding inner rod opposite the engaged outer rod. The magnetic base is integrated within the ball and socket joint, adjacent the bottommost surface of the ball and socket joint. The magnetic base attaches to any metal surface and secures the position of the telescopic leg assembly. The preferred embodiment of the couple of magnetic leveling pads each comprise a bed that surrounds the distal end of the inner rod, a rod that extends beneath the bed and connects the ball to the bed, and a socket that pivotally engages with the ball. The preferred embodiment of the socket comprises cylindrical base of which the magnetic base is housed. Alternate embodiments of the present invention may comprise a variety of mounting assembly that fix the position of the couple of telescopic legs.

Figure 3:
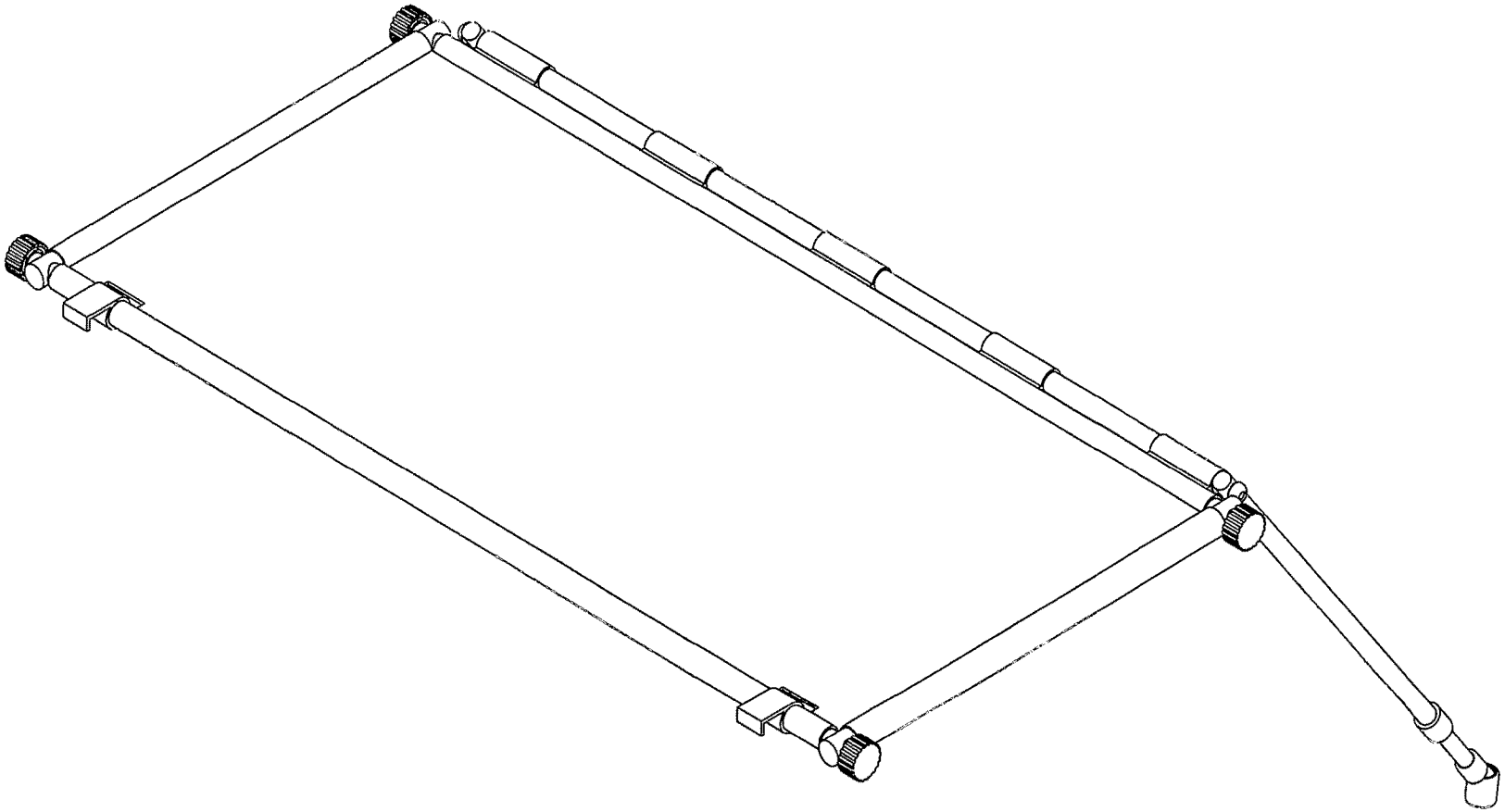
FIG. 3 is a top perspective view of the present invention with the couple of telescopic legs and couple of magnetic leveling pads angled away from the panel.

In order to properly use the present invention, the user slips the couple of anchoring posts into the corresponding frame sleeves of the panel. The couple of clips are houses within the couple of slots of the body of the panel and surround the primary anchoring post and corresponding sleeve upon insertion. The user mounts the couple of clips onto the displays of an audio console. The user inserts the corresponding distal ends of the primary anchoring post and the secondary post into the couple of slots of a connecting post. The user engages the remaining connecting post to the distal ends of the primary anchoring post and the secondary anchoring post of the opposite distal end of the apparatus. The user engages an end cap to each of the distal ends of the couple of anchoring posts that extend past corresponding connecting posts. The user inserts the connecting leg into an opening of the leg sleeve until the center of the connecting leg is aligned with the center of the body of the panel. The user aligns the slot of an outer rod with a distal end of the connecting leg. The user engages one of the fasteners with the connecting leg tightens the fastener until the outer rod is pressed against the corresponding distal end of the connecting leg. The user repeats this assembly with the remaining outer rod, the opposite distal end of the connecting leg, and the remaining fastener. The user disengages the locks of the couple of telescopic legs to retract or extend the inner rods within the corresponding outer rods. The user pivots the couple of telescopic legs about the connecting leg such that the couple of magnetic leveling pads adhere to the desired surface. The couple of telescopic legs may extend beneath the panel or away from the panel as seen in FIG. 3. The apparatus provides shade to the audio console or area directly beneath the panel. The apparatus may be easily mounted onto a variety of audio consoles.

Although the invention has been explained in relation to its preferred embodiment, it is to be understood that many other possible modifications and variations can be made without departing from the spirit and scope of the invention.

| Element Number (with FIGURE) | Name of Element |
|---|---|
| 1 (FIG. 10) | Bolt |
| 2 (FIG. 10) | Bolt |
| 3 (FIG. 10) | Connecting leg |
| 4 (FIG. 10) | End cap |
| 5 (FIG. 10) | End cap |
| 6 (FIG. 10) | Connecting post |
| 7 (FIG. 10) | Connecting post |
| 8 (FIG. 10) | Primary anchoring post |
| 9 (FIG. 10) | Secondary anchoring post |
| 10 (FIG. 10) | End cap |
| 11 (FIG. 10) | End cap |
| 12 (FIG. 10) | Clip |
| 13 (FIG. 10) | Clip |
| 14 (FIG. 10) | Outer rod |
| 15 (FIG. 10) | Lock |
| 16 (FIG. 10) | Inner rod |
| 17 (FIG. 10) | Ball and socket joint |
| 18 (FIG. 10) | Magnetic base |
| 19 (FIG. 10) | Outer rod |
| 20 (FIG. 10) | Lock |
| 21 (FIG. 10) | Inner rod |
| 22 (FIG. 10) | Ball and socket joint |
| 23 (FIG. 10) | Magnetic base |
| 24 (FIG. 10) | Frame sleeve |
| 25 (FIG. 10) | Frame sleeve |
| 26 (FIG. 10) | Frame sleeve |
| 27 (FIG. 10) | Frame sleeve |
| 28 (FIG. 10) | Frame sleeve |
| 29 (FIG. 1) | Frame |
| 30 (FIG. 1) | Telescopic leg assembly |
| 31 (FIG. 1) | Telescopic leg assembly |

-continued

| Element Number (with FIGURE) | Name of Element |
|---|---|
| 32 (FIG. 1) | Magnetic leveling pad |
| 33 (FIG. 1) | Magnetic leveling pad |

What is claimed is:

1. An apparatus for providing shade or protection from the elements to an audio console, said apparatus comprising:

a) a frame (29) comprised of:

a couple of connecting posts (6, 7), a primary anchoring post (8), a secondary anchoring post (9), a connecting leg (3), a plurality of frame sleeves (24, 25, 26, 27, 28) which house said connecting leg (3), and a plurality of end caps (4, 5, 10, 11) which connect the connecting posts (6, 7) and anchoring posts (8, 9) with threaded members that fasten onto the distal surface of the corresponding anchoring posts (8,9);

b) a waterproof and opaque flexible panel upheld by said frame (29);

c) one or more clips (12, 13) attached to said primary anchoring post (8) which attach said frame of the apparatus to an uppermost edge of a display of an audio console, said clips (12, 13) each comprising a hook and slot;

d) a telescopic leg assembly (30, 31) comprised of a couple of telescopic legs each comprising an outer rod (14, 19), an inner rod (16, 21) which is slidably engaged within the corresponding outer rod (14, 19), and a fastener (15, 20), said telescopic leg assembly (30, 31) is pivotally connected to said connecting leg sleeve (3) with fastening bolts (1, 2);

e) and a pair of magnetic leveling pads (32, 33), each comprised of a ball and socket joint (17, 22) and a magnetic base (18, 23), said magnetic leveling pads (32, 33) are pivotally connected to the inner rod (16, 21) of said telescopic leg assemblies (30, 31) opposite the frame (29).

* * * * *